US008015629B2

(12) United States Patent
Nguyen et al.

(10) Patent No.: US 8,015,629 B2
(45) Date of Patent: Sep. 13, 2011

(54) DISPENSING DEVICE

(75) Inventors: Lamson Nguyen, Somerset, NJ (US); Jeanne Marie Weller, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 1285 days.

(21) Appl. No.: 10/561,749

(22) PCT Filed: May 28, 2004

(86) PCT No.: PCT/GB2004/002267

§ 371 (c)(1),
(2), (4) Date: Feb. 22, 2006

(87) PCT Pub. No.: WO2005/001212

PCT Pub. Date: Jan. 6, 2005

(65) Prior Publication Data

US 2007/0039088 A1 Feb. 22, 2007

(30) Foreign Application Priority Data

Jun. 26, 2003 (GB) ..... 0314928.3
Nov. 7, 2003 (GB) ..... 0326136.9

(51) Int. Cl.
*E03D 9/02* (2006.01)

(52) U.S. Cl. ..... 4/227.1; 4/227.5; 4/228.1; 4/231

(58) Field of Classification Search ..... 4/231, 228.1, 4/227.1, 227.5
See application file for complete search history.

(56) References Cited

U.S. PATENT DOCUMENTS

| | | | | |
|---|---|---|---|---|
| 4,460,490 | A | 7/1984 | Barford et al. | |
| 4,537,897 | A | 8/1985 | Tessier et al. | |
| 4,555,819 | A | 12/1985 | Weiss et al. | |
| 4,560,766 | A | 12/1985 | Girard et al. | |
| 4,564,424 | A | 1/1986 | Cassat et al. | |
| 4,578,207 | A | 3/1986 | Holdt et al. | |
| 4,632,350 | A | 12/1986 | Brown | |
| 4,670,916 | A | 6/1987 | Bloom | |
| 4,742,982 | A | 5/1988 | Pilch et al. | |
| 5,759,974 | A | 6/1998 | Menke et al. | |
| 5,780,527 | A | 7/1998 | O'Leary | |
| 6,662,380 | B1 * | 12/2003 | Leonard et al. | 4/231 |

FOREIGN PATENT DOCUMENTS

| | | | |
|---|---|---|---|
| GB | 2 329 399 | A | 3/1999 |
| WO | WO 03/042462 | A | 5/2003 |

OTHER PUBLICATIONS

International Search Report dated Aug. 17, 2004 for application PCT/GB2004/002267.
International Preliminary Report on Patentability dated Nov. 4, 2005 for application PCT/Gb2004/002267.
Combined Search and Examination Report from The Patent Office in Great Britain dated Aug. 18, 2003 for application GB 0314928.3.
Combined Search and Examination Report from The Patent Office in Great Britain dated Apr. 19, 2004 for application GB 0326136.9.
Response to Written Opinion dated Apr. 19, 2005 for application PCT/GB2004/002267.

* cited by examiner

*Primary Examiner* — Tuan Nguyen
(74) *Attorney, Agent, or Firm* — Norris, McLauglin & Marcus, P.A.

(57) ABSTRACT

A device useful for the delivery of a treatment composition, and a fragrancing effect to a sanitary appliance, especially a toilet bowl.

9 Claims, 3 Drawing Sheets

DISPENSING DEVICE

The present invention is related to devices which are useful in dispensing a treatment composition (e.g, cleaning and/or sanitizing and/or coloring composition) to a sanitary appliance, e.g., a toilet bowl, while simultaneously dispensing a fragrance or perfume to the ambient environment outside of the sanitary appliance.

Since the advent of sanitary appliances, particularly toilet bowls, there is has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls. While many of these devices are known and widely used they are not without drawbacks. One common technical problem is to ensure the effective delivery of a treatment agent, especially a coloring agent and/or a cleaning and/or a sanitizing agent to the interior of a toilet, while at the same time providing a fragrancing effect in the proximity of the toilet. One common approach known to the art is to provide a device which is suspended from the rim of the toilet bowl and which is placed at or near the interior sidewall of the toilet bowl. Such a device is designed to typically dispense a treatment composition to the interior of a toilet typically when contacted with flushing water, or alternately, it dispenses a fragrancing composition to the toilet bowl which is intended to counteract or mask malodors. Certain known arts devices can provide these effects simultaneously. While beneficial, there is nonetheless a real and continuing need in the art to provide improved devices which can provide a fragrancing effect as well as other treatment effects, e.g., cleaning and/or sanitizing and/or coloring to a sanitary appliance, particularly a toilet.

The present invention, in its various aspects, provides a device useful for the delivery of a treatment composition, as well as a fragrancing composition to a sanitary appliance, e.g. a toilet bowl. The device can be used either as an ITC type device, or an ITB type device for a toilet bowl.

According to one aspect of the invention there is provided a device useful in conjunction with a toilet bowl or other sanitary appliance which device provides for the delivery of a treatment composition, particularly a treatment composition selected from a coloring composition and/or a cleaning composition and/or sanitizing composition, which contains one or more active agents such as a coloring agent, cleaning agent, disinfecting agent, and/or an anti-lime scale agent or a mixture of two or more of these agents, while simultaneously providing a fragrancing effect to the ambient environment of the sanitary appliance as well, wherein the device includes (a) a first dispenser for containing a treatment composition, particularly a treatment composition selected from a coloring composition and/or a cleaning composition and/or sanitizing composition, which first dispenser permits for passage of water contained within the sanitary appliance into and out of contact with the said treatment composition;

(b) a second dispenser for containing a fragrancing composition, which, during the use of the device, the fragrancing composition desirably does not contact water in the sanitary appliance, and (c) a hanger connecting the first dispenser to the second dispenser, which hanger is adapted for removably hanging the device upon a portion of a sanitary appliance.

In a further aspect the present invention also comprises a process for delivering a a treatment composition, particularly a treatment composition selected from a coloring composition and/or a cleaning composition and/or sanitizing composition to the interior of a sanitary appliance, particularly a toilet bowl, which process contemplates providing a device as described herein and installing the device within or upon at least a portion of a sanitary appliance, particularly a toilet bowl whereby the said treatment composition contacts water contained within the sanitary appliance, while simultaneously providing a fragrancing effect to ambient environment of the sanitary appliance.

These and other aspects of the invention will become more apparent from the following detailed description of the invention, and drawings.

Figure 1:
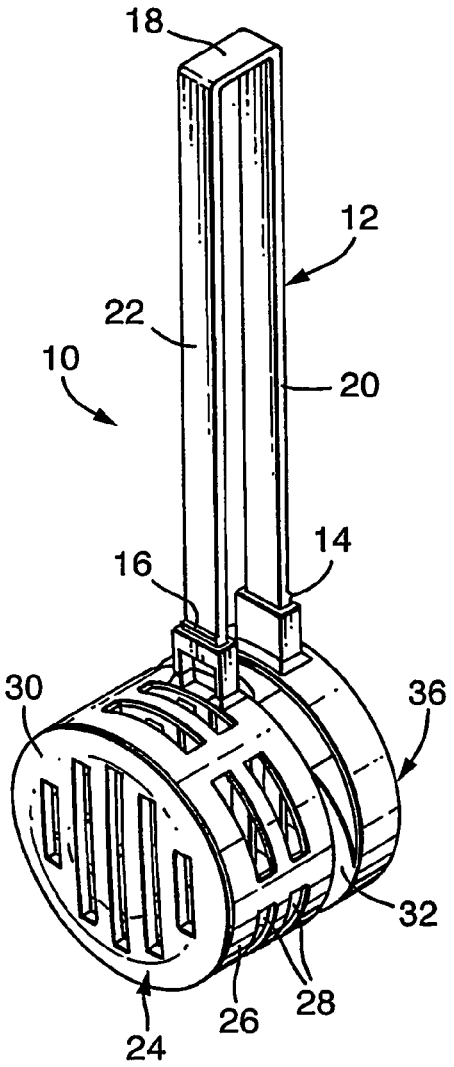
FIG. 1 illustrates a perspective view of a first embodiment of a device according to the invention.

The device according to the invention is used to simultaneously deliver a treatment composition from a first dispenser to water contained within the sanitary appliance, which treatment contains one or more active agents such as a coloring agent, cleaning agent, disinfecting agent, anti-lime scale agent, or is a mixture of two or more agents, while from the second dispenser a fragrance composition is provided to the ambient environment of the sanitary appliance.

Both the treatment composition, as well as the fragrance composition may be in provided to the device in any physical form, e.g., in a liquid, gel or solid form. Conveniently however, the treatment composition is in the form a gel form or is in a solid form, such as in the form of dissolvable block which provides for the long term release of an active agent during sequential contacts with water entering and exiting the first housing of the device.

The treatment composition may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the treatment compositions of the invention.

By way of non-limiting example, useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$-$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Exemplary useful are linear straight chain alkylbenzene sulfonates in which the average number of carbon atoms in the alkyl group is from about 11 to 14.

Further exemplary useful anionic surfactants herein are the water soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Still further exemplary useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

A further class of anionic surfactants which may be used include carboxylates such as alkyl carboxylates which include those which may be represented by the general formula:

$$R—COO^-M^+$$

wherein R is a straight or branched hydrocarbon chain containing from about 9 to 21 carbon atoms, and M is a metal or ammonium ion; polyalkoxycarboxylates, representative of which are polyethoxycarboxylates which may be represented by the general formula:

$$R—[—OCH_2CH_2—]_n—CH_2COO^-M^+$$

wherein R is a straight chained or branched hydrocarbon chain which may include an aryl moiety, but is desirably a straight chained or branched hydrocarbon chain; and n is an integer value of from 1-24.

Preferred anionic surfactants are those anionic surfactants typically used in toilet cleaning compositions. Examples include sulfonates, sulfates, carboxylates, phosphates, and mixtures of the above compounds. Suitable cations in this case are alkali metals such as, for example, sodium or potassium, or alkaline earth metals such as, for example, calcium or magnesium, and ammonium, substituted ammonium compounds, including mono-, di- or triethanolammonium cations and mixtures of the cations. The following types of anionic surfactants are of particular interest: alkyl ester sulfonates, alkylsulfates, alkyl ether sulfates, alkylaryl sulfates and sulfonates, and secondary alkanesulfonates, alkenyl sulfonates. Examples of suitable anionic surfactants include alpha olefin sulfonates, dodecylbenzene sulfonates, lauryl ether sulfates, lauryl monethanol amides.

Exemplary nonionic surfactants which may find use in the present invention include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

A particularly useful class of nonionic surfactants include alkoxy block copolymers which include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z—H \quad (A)$$

where

EO represents ethylene oxide,

PO represents propylene oxide, y equals at least 15, $(EO)_{x+z}$ equals 20 to 80% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x—H \quad (C)$$

wherein

R is an alkyl group containing 1 to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y—H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

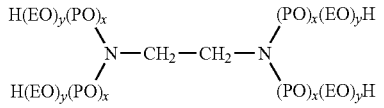

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further exemplary useful nonionic surfactants which may be used in the present invention include certain alkanolamides including monoethanolamides and diethanolamides, particularly fatty monoalkanolamides and fatty dialkanolamides. Commercially available monoethanol amides and diethanol amides include those marketed under the trade names Alakamide® and Cyclomide® by Rhône-Poulenc Co., (Cranbury, N.J.).

Preferred nonionic surfactants which may be used are those selected from primary and secondary alcohol ethoxylates and alkoxy block copolymers based on ethylene oxide, propylene oxide, and/or butylene oxide and mixtures thereof. For the alcohol ethoxylates, the alkyl chain of the aliphatic alcohols can be linear or branched, primary or secondary, and generally contains from about 8 to about 22 carbon atoms. The alkyl chain can be saturated or unsaturated. The alcohol ethoxylates can have a narrow ("narrow range ethoxylates") or a broad ("broad range ethoxylates") homolog distribution of the ethylene oxide. Examples of commercially available nonionic surfactants of this type are available under the tradenames Tergitol®, Genapol®, and Neodol®. Preferably, the alcohol ethoxylates are mixed C9/11 or C11/15 alcohol ethoxylates, condensed with an average of from 6 to 15 moles, preferably from 6 to 12 moles, and most preferably from 6 to 9 moles of ethylene oxide per mole of alcohol. Preferably the ethoxylated nonionic surfactant so derived has a narrow ethoxylate distribution relative to the average.

Further particularly preferred nonionic surfactants which may be used are nonionic surfactants based on block copolymers represented by formula (A) specific examples of which include those materials presently commercially available under the tradename Pluronic® (ex. BASF). Of those of formula (A), block copolymers having an average molecular weight between 7000 to 11,000 are preferred. Examples of such components include Pluronic® 87, described as $EO_{61}$ $PO_{41.5}$ $EO_{61}$, having an average molecular weight of about 7700 and Pluronic® 88, described as $EO_{98}$ $PO_{41.5}$ $EO_{98}$, having an average molecular weight of about 10800.

Non-limiting examples of exemplary useful amphoteric surfactants include alkylbetaines, particularly those which may be represented by the following structural formula:

$$RN(CH_3)_2CH_2COO^-$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^+(CH_3)_2CH_2COO^-$$

wherein R is a straight or branched hydrocarbon chain which may include an aryl moiety, but is preferably a straight hydrocarbon chain containing from about 6 to 30 carbon atoms.

The treatment compositions of the invention may include one or more sanitizing agents or sanitizing constituents which may be used with or without other constituents being present in the treatment compositions of the invention.

The sanitizing agent can be any sanitizing composition known to those of ordinary skill in the relevant art, and without limitation exemplary sanitzing compositions include materials containing alkyl halohydantoins, alkali metal haloisocyanurates, essential oils, non-quaternary ammonium based germicidal compounds as well as quaternary ammonium germicidal compounds. These one or more sanitizing agents may be used with or without other constituents being present in the treatment compositions of the invention.

By way of non-limiting example, exemplary useful halohydantoins which may be used include those which may be represented by the general structure:

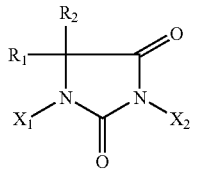

wherein:

$X_1$ and $X_2$ are independently hydrogen, chlorine or bromine; and, $R_1$ and $R_2$ are independently alkyl groups having from 1 to 6 carbon atoms.

Examples of halohydantoins include, for example, N,N'-dichloro-dimethyl-hydantoin, N-bromo-N-chloro-dimethylhydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. These materials are more fully discussed in U.S. Pat. Nos. 4,560,766; 4,537,897; and 4,564,424, the contents of which are incorporated by reference.

Other germicdally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Functional Materials, Vol.* 2, 1998; *Kirk-Othmer, Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Exemplary cationic surfactant compositions useful in the practice of the instant invention are quaternary ammonium compounds and salts thereof, which may be characterized by the general structural formula:

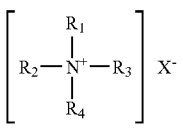

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least about 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Such quaternary compounds are available under the BARDAC®, BARQUAT®, HYAMINE®, LONZABAC®, BTC®, and ONYXIDE® trademarks, which are more fully described in, for example, *McCutcheon's Functional Materials* (Vol. 2), North American Edition, 2001, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT® 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500-80); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80));

BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125-80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.).

The treatment compositions of the invention may also comprise a coloring agent which imparts a color to the water in which it comes into contact, and especially which imparts color to the water contained within the sanitary appliance. Where the sanitary appliance is a toilet, desirably the coloring agent imparts a color to the water contained within the cistern, or within the toilet bowl particularly following the flush cycle of a toilet, or in both locations. Such coloring agents have great consumer appeal, and indeed any known art coloring agent may be provided in any effective amount in order to impart a coloring effect. Colorants, especially dyes, are preferred when formulated as dry powders to enable direct incorporation into the tablet or block, however, liquid colorants may be employed in conjunction with suitable carriers. Colorants are desirably present in an amount from about 0.1 to 15 percent.

While such coloring agents may be used as the sole active water treatment agent contained within the first dispenser of the inventive device, such coloring agents typically combined with cleaning effective amounts of one or more surfactants which provide an effective cleaning benefit.

As noted previously, the treatment compositions of the invention may comprise an anti-limescale agent, which can be classified as a cleaning agent in that it provides a cleaning effect to treated lavatory device surfaces. The anti-lime scale agent agent can virtually any known anti-lime scale agent compositions known to those of ordinary skill in the relevant art. For example, compositions containing anionic and/or nonionic surfactants together with typical anti-lime-scale agents, for example, amidosulfonic acid, bisulfate salts, organic acids, organic phosphoric salts, alkali metal polyphosphates, and the like. Examples of anti-lime scale agent compositions can be found in, for example, U.S. Pat. No. 5,759,974; U.S. Pat. No. 4,460,490; and U.S. Pat. No. 4,578,207, the contents of which are herein incorporated by reference. Further examples of anti-lime scale agents include organic acids (for example, citric acid, lactic acid, adipic acid, oxalic acid and the like), organic phosphoric salts, alkali metal polyphosphates, sulfonic, and sulphamic acids and their salts, bisulfate salts, EDTA, phosphonates, HEDP and the like.

The treatment compositions may also include other known-art additives in effective amounts, such as solubility control agents, water-softening agents, preservatives, flow aids, water-soluble fillers, corrosion inhibitors, and the like.

It will be appreciated by those of ordinary skill in the art that several of the components which are directed to provide a treatment composition can be blended into one composition with the additional appreciation that potential blending of incompatible components will be avoided. For example, those of ordinary skill in the art will appreciate that certain anionic surfactants may have to be avoided as some may be incompatible with some of the disinfecting agents and anti-lime scale agents mentioned herein. Those of ordinary skill in the art will appreciate that the compatibility of the anionic surfactant and the various disinfecting and anti-lime scale agents can be easily determined and thus incompatibility can be avoided in the situations.

When formed into solid blocks, such blocks can consist entirely of one or more of the active agents described above but such blocks may also contain effective amounts of one or more active agents with one or more inactive adjuvants known to the art to be useful in such compositions including, without limitation, fillers, colorants, dyes, and the like. Such may be included in art recognized amounts.

Preferably when the composition is in a solid block form, the solid composition according to the invention is made up into a block of from about 25 to about 75 g, more preferably from about 25 to about 55 g, and more preferably from about 30 to about 45 g.

The solid block can be made by conventional means from the known compounds. One method of making the block is to melt the components making up the compositions of interest and then pouring the molten mass into the first chamber of the housing and allowing the mass to cool to room temperature (about 25° C.). Another method is to place the components of interest into an appropriate extrusion device and extrude an appropriately sized mass that will fit into the first chamber of the housing. If the solid is to be made by extrusion, then processing aids are needed.

As noted, the device according to invention includes a second dispenser for providing a fragrancing effect to the ambient environment of the sanitary appliance, which second dispenser comprises a fragrance composition. The fragrance composition may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential oils may also function as a fragrance agent, which fragrance agent which may be a substance or mixture of such substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention. Indeed, is fully contemplated as being within the scope of the invention to include any other material which is useful in providing treatment of ambient air, such as a sanitizing agents such as one or more glycols or alcohols, or materials which are intended to counteract, neutralize, or mask odors in place of, or in conjunction with the fragrance composition of the present invention. Alternatively, it is also contemplated that all or part of the fragrance composition of the present invention is may be substituted by one or more materials which provide and effective insecticide repelling or insecticidal benefit; such would be particularly useful in climates or environments where insects present a nuisance or health hazard.

According to particularly preferred embodiments of the invention, the fragrance composition is associated solely with the second dispenser of the invention. In this preferred as, according to preferred mode of utilizing the inventive device, the device is positioned with respect to a sanitary appliance, particularly a toilet bowl, such that the second dispenser does not come into contact with water during the useful life of the device. This provides several simultaneous benefits including, the longevity of the fragrance composition, the improved delivery characteristic of the fragrance composition which does not become submerged or diluted with water associated with the sanitary appliance, as well as the fact that a much broader range of fragrance compositions (or other air treatment compositions as noted above) can be utilized as, there is no concern regarding the compatibility of fragrance with the materials in the treatment composition of the first dispenser. Furthermore, the utilization of the fragrance composition solely in conjunction with the second dispenser also provides a constant release of the fragrance composition to the ambient environment of the sanitary appliance even when the sanitary appliance is not being the used. In the case where pleasant fragrance and/or odor masking composition is provided in the fragrance composition, a beneficial consumer perception of the use of the products can be realized. Alternately, where a sanitizing agent and/or an insecticidal agent is utilized as all or part of the fragrance composition of the second dispenser, the continual benefits of continuous release of such agency may be provided.

Nonetheless, it is to be understood that the treatment composition of the first dispenser can also contain a fragrance composition, or other air treatment composition as described above. Such however exemplifies a less preferred inventive embodiment for the reasons noted herein.

The form of the fragrance composition can take any form including, liquid, solid, or gel form. Preferably however, the fragrance composition is a gel system which is then deposited in the fragrance chamber of the device. The gel system can be formed by a variety of components known to those of ordinary skill in the art. For example, it can be formed from absorbents, starch based systems, modified celluloses, natural gums and other materials which can form a gel when the fragrance composition, aforementioned gel components, and water or hydrophilic solvents are mixed together. According to certain particularly advantageous embodiments of the invention the fragrance composition is a gel system as it is described in U.S. Pat. No. 5,780,527, the contents of which are hereby incorporated by reference.

Examples of treatment compositions which can be used with the present invention are shown in the following table below.

| Component | Ex. 1 | Ex. 2 | Ex. 3 | Ex. 4 | Ex. 5 |
|---|---|---|---|---|---|
| Dodecyl Benzene Sulfonate Na[1] | 25 | 10 | 40 | 35 | 35 |
| Alfa Olefine Sulfonate Na[2] | 25 | 10 | 5 | 32 | 32 |
| Lauryl monoethanolamide[3] | 10 | 8 | 5 | 2 | 5 |
| Sodium Lauryl Ether Sulfate[4] | 10 | — | — | 4.5 | 5 |
| Pluronic 68[5] | 10 | — | — | 3 | — |
| Na Sulfate | 20 | — | — | 21.5 | 21 |
| Pluronic 87 or 88[6] | — | 70 | 50 | — | — |
| Alcohol ethoxylate $C_9$-$C_{11}$ 6EO[7] | — | 2 | — | — | — |
| Silica | — | — | — | 2 | 2 |

[1]Dodecyl Benzene Sulfonate Sodium (80-90% active)—anionic
[2]Alpha Olefin Sulfonate Sodium—anionic
[3]Lauryl Monoethanolamide—non-ionic
[4]Sodium Lauryl Ether Sulfate (70% active)—anionic
[5]Polyoxyethylene (160) polyoxypropylene (30) glycol—non-ionic
[6]Pluronic 87 $E_{61}P_{41.5}E_{61}$—Molecular Weight 7700—HLB 24—non-ionic Pluronic 88 $E_{98}P_{41.5}E_{98}$—Molecular Weight 10800—HLB 28—non-ionic
[7]Alcohol ethoxylate $C_9$-$C_{11}$6EO—non-ionic The above exemplary compositions can be made either by melting the various components together and placing the melt into a housing which is used as the first dispenser of the inventive device, or by placing the components into a suitable extruder and extruding out a block having a desired shape and size, and thereafter providing it to the first dispenser of the inventive device.

Exemplary sanitizing compositions for use in the present invention include compositions having the general compositions described as follows:

A hydantoin tablet containing 94 wt. % Dantochlor powder (about 86% 1,3-dichloro-5,5-dimethylhydantoin) and 6.0 wt. % of an inert binder, comprising a 5 wt. % solution of laponite can be made by extrusion (with a die diameter and shape suited to the proposed first chamber) at a temperature of from about 80 to 90° F. and a pressure at the end of the extruder barrel ranging from about 50 to about 350 psi. An appropriately sized block can then be cut from the extrudate and allowed to cool to room temperature. Another example can use a 2 wt. % solution of laponite. According to other examples the 5 wt. % solution of laponite can be replaced with sodium stearate and water (respectively representing 5 wt. % and 4 wt. % of composition prior to drying; respectively representing 10 wt. % and 6 wt. % of the final composition prior to drying; and respectively representing 6 wt. % and 7.5 wt. % of the composition, prior to drying). Alternately there can be used a binder that contains a 2 wt. % laponite solution and sodium stearate (the laponite solution representing 3 wt. % of the composition and the sodium stearate representing 7.5 wt. % of the composition, prior to drying; a 5 wt. % laponite solution and sodium stearate (respectively representing 3 wt. % and 7.5 wt. % of the composition, prior to drying).

An example of a bleach containing composition suitable for use as a treatment composition in the devices of the present invention include compositions having the general ranges as follows:

| Component | Range Percentage w/w |
|---|---|
| Alpha olefin sulfonate | 0-35 |
| Sodium lauryl ether sulfate | 3.0-6.0 |

-continued

| Component | Range Percentage w/w |
|---|---|
| Bleaching agent (e.g., DCCNa or Hydantoin) | 0.5-25 |
| Lauryl monoethanolamide | 2.0-5.0 |
| Dodecyl benzene sulfonate Na | 50-70 |
| Na sulfate anhydrous | 15-25 |
| Silica | 1.0-2.0 |

A non-limiting examples of a anti-lime scale agent containing composition useful as a treatment composition in the devices of the present invention include compositions described as follows:

| Description | Qty |
|---|---|
| Spary dried silica | 9.46 |
| Na sulfate | 10.81 |
| Na dodecylbenzenesulfonate (80%) | 74.05 |
| $Na_4$ HEDP | 1.62 |
| Alcohol $C_{13}/C_{15}$ | 1.08 |
| Dye | 2.97 |

In the devices according to the present invention, it is to be understood that the form on the first dispenser as well as the form of the second dispenser is not critical to the successful operation of the invention. It is only required that be appropriately dimensioned or appropriately sized in order that they may contain, or have otherwise associated therewith, their corresponding treatment compositions, or alternately their fragrancing compositions. According to certain preferred embodiments of the invention, both the first dispenser and the second dispenser include a housing having at least one cavity contained therein, which cavity is appropriately sized or dimensions to receive and to retain their corresponding treatment compositions or fragrancing compositions. Such housings may include covers which may facilitate in retaining the compositions contained therein. Desire bleak, the housings also include at least one or more perforations, or for that matter may include wholly exposed surfaces which permit for the contact of water with the treatment compositions, or alternately which permit for the contact of ambient air with the fragrance compositions when the inventive devices are in a use.

A further element of the device according to the invention is a hanger connecting the first dispenser to the second dispenser, which hanger is adapted for removably hanging the device upon a portion of a sanitary appliance. The form of the hanger may take any shape form or configuration which is found satisfactory. Ideally, the hanger is generally in the form of a rigid, semi-rigid or flexible strip having a one end thereof the first dispenser attached thereto, and at the other and thereof, the second dispenser attached thereto. In use, according to preferred methods for utilizing the dispenser, the hanger is used to suspend the first dispenser containing the treatment composition within the flow path of water within the sanitary device, while simultaneously suspending the second dispenser containing the fragrance composition such that it does not normally, into contact with water, nor with the flow path of water within the sanitary device. According to one particularly preferred method of use, the device is utilized in conjunction with a toilet having a tank or cistern which is used to store water in between flushes. In this method, the hanger is suspended upon the upper rim of the tank such that, the first dispenser is immersed in water contained within the tank present between flushes, while simultaneously, the second dispenser is suspended on the exterior of the tank thereby permitting the emanation of the fragrance composition to the ambient environment of the toilet bowl. In this manner, the inventive device operates as an ITC type device. In another particularly preferred method of use, the device is utilized in conjunction with a toilet bowl such that, the hanger is suspended upon the rim of the toilet bowl, such that the first dispenser is suspended into the interior of the toilet bowl, while the second dispenser is suspended on the exterior of the toilet bowl such that, during the release of flush water into the toilet bowl, at least part of the first dispenser and the treatment composition is contacted with the flush water. In this manner, the inventive device operates as an ITB type device. Other methods of use, although not specifically recited here are also contemplated as being within the scope of the present invention The various elements of the device according to the invention can be formed out of any of a variety of materials with synthetic polymers being preferred. Exemplary suitable synthetic polymers include polyethylene, polypropylene, and the like; the only criteria being that the selected synthetic polymers is not affected by the components of the treatment composition, or fragrance composition particularly when in a gel form or solid form.

The device according to the invention may also have a different geometry and appearance than the embodiments described in the Figures. For example the hanger may be a rigid material which is stiff, or which may be a flexible material, such as in the form of a flexible band or strap. Further, each of the first and second dispensers may have a configuration other than specific embodiments depicted in the Figures. Further the forms of the individual dispensers depicted may be interchanged with like dispensers depicted on different figures.

In the accompanying figures, like elements are indicated using the same numerals throughout the figures.

Turning now to the figures, FIG. 1 illustrates a perspective view of an embodiment of the device 10 according to a first embodiment of the invention. The device 10 includes a hanger 12 having a first end 14, and at the opposite end thereof, a second end 16. In the configuration shown in FIG. 1, the hanger 12 has a generally "U" shaped configuration, including a central bridge section 18 having downwardly dependent therefrom the two legs 20, 22 terminating at respective ends 14, 16 as described above and as depicted in FIG. 1. In the embodiment, each of the legs 20, 22 are of essentially the same length, although of course such is not a necessity in the practice of the present invention.

Affixed to the end 16 is a first dispenser 24 in the form of a housing adapted to contain a treatment composition (not shown). In the embodiment illustrated in FIG. 1, the first housing 24 has a generally cylindrical geometry having a sidewall 26 which includes a plurality of perforations 28 providing access to the interior of the first housing, as well as a perforated top cover 30 and a perforated bottom cover 32 at opposite ends of the sidewall 26. Although not shown in FIG. 1, a treatment composition, especially in the form of a block is intended to be inserted into the interior of the first housing 24. The presence of the various perforations permit for the entry and egress of water in the sanitary appliance to enter and exits the first housing 24 and thereby come into contact with the treatment composition.

Affixed to the end 14 is a second dispenser 34 in the form of a housing adapted to contain a fragrance composition. While not visible in FIG. 1, the second dispenser 34 contains a cavity 36 which is adapted to contain a quantity of the fragrance composition, particularly when in the form of a gel or any solid, but especially particularly a gel. In the embodiments shown in FIG. 1, the cavity faces away from the direction of the first dispenser 24. Such an arrangement thereby permits for an unobscured face of the fragrance composition to be presented to the ambient environment.

While not specifically illustrated in the figures, the device of FIG. 1 is particularly adapted to be used with a toilet bowl having a cistern such that, the bridge 18 is suspended from the hopper margin on the cistern, such that the device is suspended whereby he first dispenser 24 containing the treatment composition is contained within the interior of the cistern and comes into contact with the water contained within the cistern, and wherein the second dispenser 36 is positioned on the exterior of the cistern, and wherein the fragrance composition contained therein comes into contact with the ambient environment of the toilet bowl.

Figure 2:
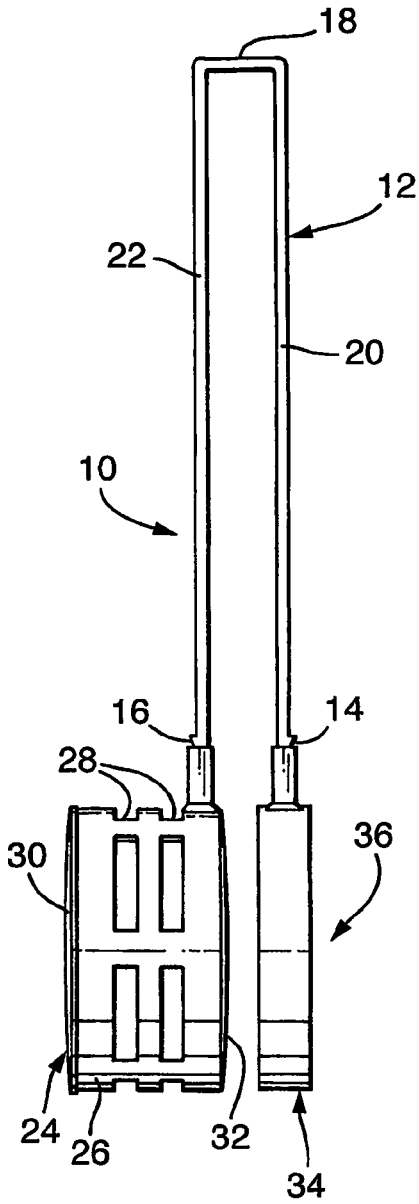
FIG. 2 illustrates a side plan view of the device of FIG. 1.

FIG. 2 illustrates a side plan view of the device of FIG. 1, providing a more detailed view of the respective positioning of the various elements of the device described with reference to FIG. 1

Figure 3:
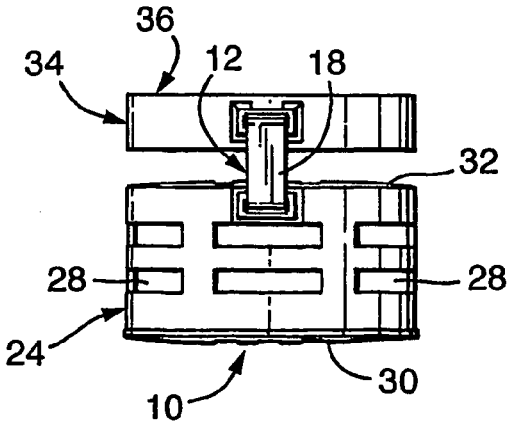
FIG. 3 illustrates a side plan view of the device of FIG. 1.

FIG. 3 illustrates a side plan view of the device of FIG. 1, in this view from the top of the hanger 12 illustrating the "side-by-side" spatial relationship of the housing of the first dispenser 24 and housing of the second dispenser 34.

Figure 4:
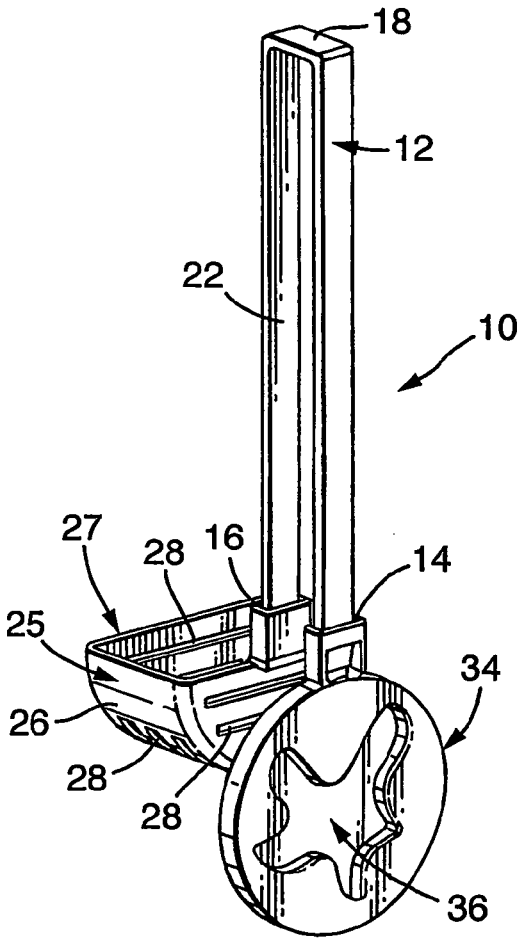
FIG. 4 illustrates a side plan view of a second embodiment of a device according to the invention.

FIG. 4 illustrates a side plan view of a second embodiment of a device 10 according to the invention. The device 10 includes a hanger 12 having a first end 14, and at the opposite end thereof, a second end 16. In the configuration shown in FIG. 1, the hanger 12 has a generally "U" shaped configuration, including a central bridge section 18 having downwardly dependent therefrom the two legs 20, 22 terminating at respective ends 14, 16 as described above and as depicted in FIG. 1. In the embodiment, each of the legs 20, 22 are of essentially the same length, although of course such is not to be understood to be a limitation.

Affixed to the end 16 is a first dispenser 25 in the form of an open-ended housing adapted to contain a treatment composition (not shown), and having an open end 27 permitting access to the interior of the first dispenser 25. In the embodiment illustrated in FIG. 4 the first housing 25 has having a generally bisected cylindrical geometry having a sidewall 26 which includes a plurality of perforations 28 providing access to the interior of the first housing 25. Although not shown in FIG. 4, a treatment composition, especially in the form of a block or a gel is well suited to be inserted into the interior of the first housing 25. The presence of the various perforations permit for the entry and egress of water in the sanitary appliance to enter and exits the first housing 25 and thereby come into contact with the treatment composition.

Affixed to the end 14 is a second dispenser 34 in the form of a housing adapted to contain a fragrance composition. The second dispenser 34 contains a cavity 36 which is adapted to contain a quantity of the fragrance composition, particularly when in the form of a gel or any other solid form, but especially particularly a gel. In the embodiment shown in FIG. 4, the cavity 36 faces away from the direction of the first dispenser 24. Such an arrangement thereby permits for an unobscured face of the fragrance composition to be presented to the ambient environment.

While not specifically illustrated in the figures, the device of FIG. 4 is particularly adapted to be used with a toilet bowl having a cistern such that, the bridge 18 is suspended from the hopper margin on the cistern, such that the device is suspended whereby the first dispenser 25 containing the treatment composition is contained within the interior of the cistern and comes into contact with the water contained within the cistern, and wherein the second dispenser 36 is positioned on the exterior of the cistern, and wherein the fragrance composition contained therein comes into contact with the ambient environment of the toilet bowl.

Figure 5:
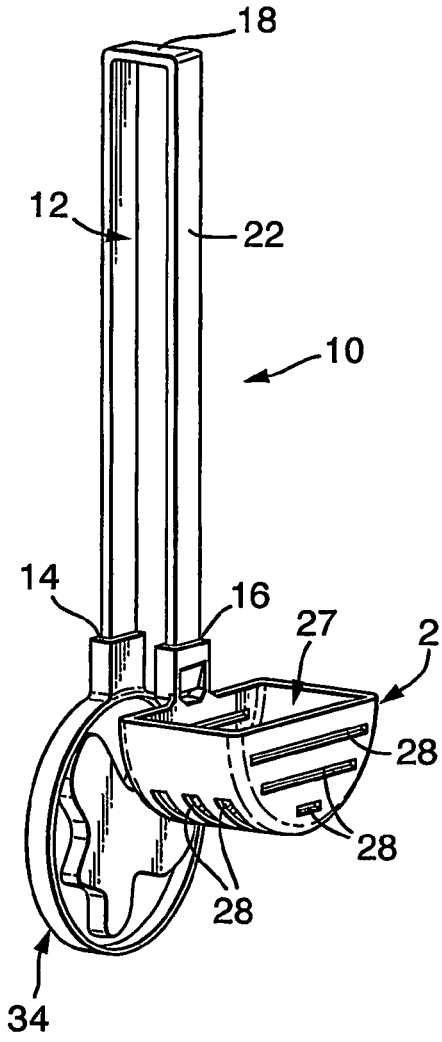
FIG. 5 illustrates a further side plan view of the device of FIG. 4.

FIG. 5 illustrates a further side plan view of the device of FIG. 4, including with more particularity the first dispenser open end 27 permitting access to the interior of the first dispenser 25.

Figure 6:
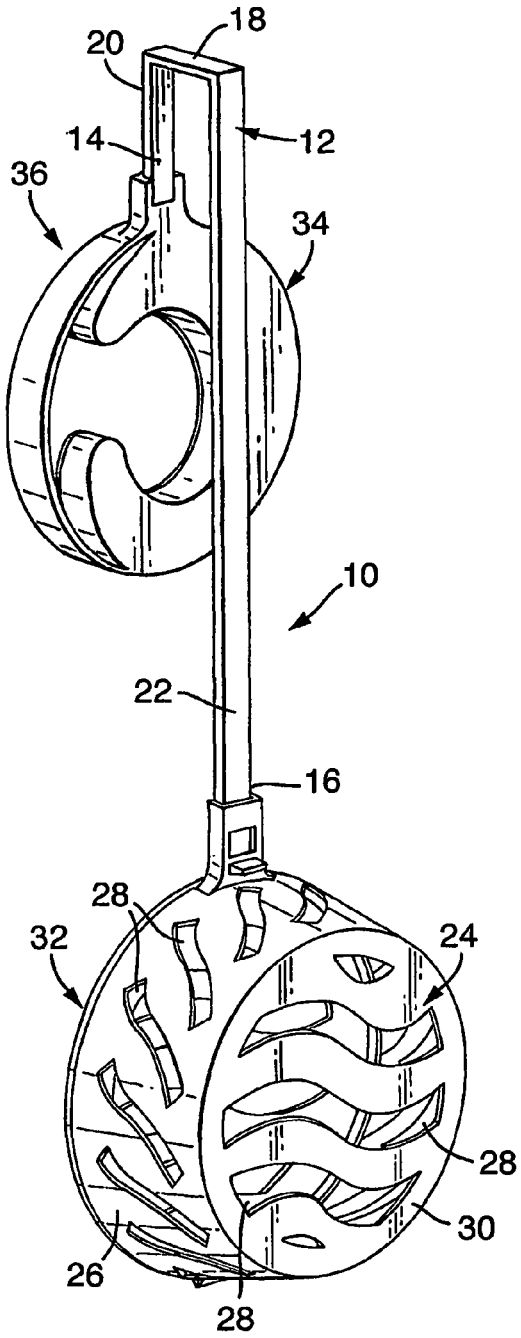
FIG. 6 illustrates a perspective view of a third embodiment of a device according to the invention.
Figure 7:
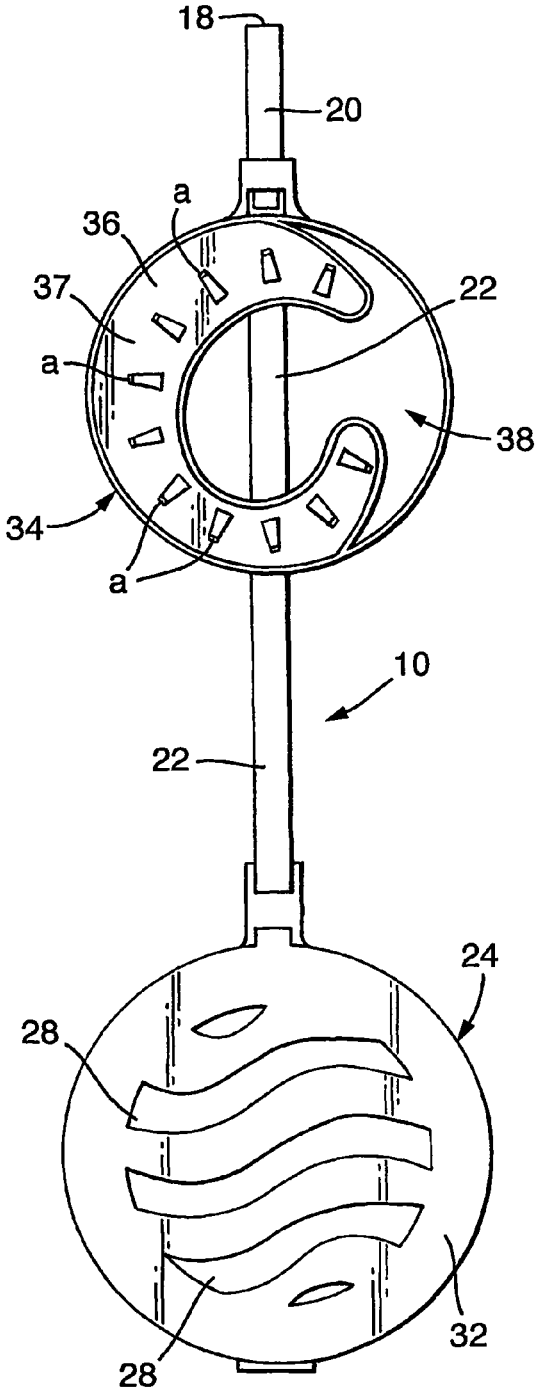
FIG. 7 illustrates a side plan view of the device according to FIG. 6.

A preferred embodiment of an inventive device is illustrated on FIGS. 6 and 7.

Turning now to FIG. 6 therein is illustrated a perspective view of a third and a preferred embodiment of a device according to the invention. The device 10 includes a hanger 12 having a first end 14, and at the opposite end thereof, a second end 16. In the configuration shown in FIG. 1, the hanger 12 has a generally "U" shaped configuration, including a central bridge section 18 having downwardly dependent therefrom the two legs 20, 22 terminating at respective ends 14, 16 as described above and as depicted in FIG. 1. dissimilar length which effectively ensures that the first housing 24 adapted to contain a treatment composition (not shown) is not in a "side-by-side" configuration with the second dispenser 34 in the form of a housing adapted to contain a fragrance composition. In the embodiment illustrated in FIG. 6, the first housing 24 has a generally frustoconical geometry having a sidewall 26 which includes a plurality of perforations 28 providing access to the interior of the first housing, as well as a perforated top cover 30 and a perforated bottom cover 32 at opposite ends of the sidewall 26. Although not shown in FIG. 1, a treatment composition, especially in the form of a block is intended to be inserted into the interior of the first housing 24. As discussed previously the presence of the various perforations permit for the entry and egress of water in the sanitary appliance to enter and exits the first housing 24 and thereby come into contact with the treatment composition contained within.

Affixed to the end 14 is a second dispenser 34 in the form of a housing adapted to contain a fragrance composition. While not visible in FIG. 5, the second dispenser 34 contains a cavity 36 which is adapted to contain a quantity of the fragrance composition, particularly when in the form of a gel or any solid, but especially particularly a gel. In the embodiments shown in FIG. 1, the cavity faces away from the direction of the first dispenser 24. Such an arrangement thereby permits for an unobscured face of the fragrance composition to be presented to the ambient environment.

The preferred embodiment of the inventive device is particularly adapted to be used with a toilet bowl having a cistern in the same manner as that described with reference to the first embodiment depicted on FIG. 1.

According to the present embodiment the length (the distance from the bridge 18 to the respective ends 14, 16 of each of the two legs 20, 22) are dissimilar. Preferably the length of leg 20 is not more than 70% of the length of leg 22, more preferably not more than 50%, still more preferably not more than 30%, yet more preferably not more than 25%, and most preferably is not more than 20% of the length of leg 22. Such a configuration of the length of each of the two legs 20, 22 provides a particularly attractive and a particularly form of the device which provides good performance. Wherein such an embodiment is suspended upon the tank wall forming the cistern of a toilet bowl, the first housing 24 containing the treatment composition is suspended downwardly in the interior of the cistern. In such a position, it is likely to be immersed within the flush water contained within the cistern irregardless of the variation in water levels in the cistern which may occur from time to time during normal operation, as well as during the flush cycle. On the other hand, the second dispenser, being suspended from a shorter let 20 is particularly adapted to be positioned on the tank wall of the cistern on the front, i.e., the side visible to the user of the toilet. In such a position the second dispenser is very visible to the user of the toilet who can quickly visually check to determine if the fragrance composition, particularly when in the form of a gel or any solid is exhausted as is often evidenced by shrinking of the gel. Additionally such a positioning of the device ensures that good exposure of the fragrance composition is provided in a position proximate to the toilet bowl.

FIG. 7 illustrates a side plan view of the device 10 according to FIG. 6, more clearly depicting certain details of the second dispenser 34 including the cavity 36 which further includes a plurality of retention elements "a" present within the interior of the cavity 36 and are solid elements around which the solid or gel fragrance composition is anchored. In the embodiment shown in FIG. 7 the retention elements "a" are in the form of spikes which extend upwardly from the floor 37 of the cavity. Other forms of the solid elements are also clearly contemplated. Also visible in FIG. 7 is a passage 38 through the second dispenser 34, as evidenced by the depiction of part of the leg 22 within the passage 38. The presence of such a passage 38 is in some embodiments preferred as such minimizes the visual impact of the second dispenser 34 by permitting the user to view at least a part of the tank wall of the cistern within the second dispenser.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A device adapted to be installed on a rim of a cistern of a toilet bowl which device provides for the delivery of a treatment composition to the cistern, which contains one or more active agents such as a coloring agent, cleaning agent, disinfecting agent, and/or an anti-lime scale agent or a mixture of two or more of these agents, while simultaneously providing a continuous fragrancing effect to the ambient environment of the cistern, wherein the device includes:

(a) a first dispenser for containing a treatment composition, which first dispenser is immersed in water contained within the cistern between flushes of the toilet bowl and permits for passage of water contained within the cistern into and out of contact with the first dispenser containing said treatment composition and with said treatment composition;

(b) a second dispenser for containing a fragrancing composition, which, during the use of the device, the fragrancing composition is exterior of the cistern and does not contact water in the cistern, and (c) a hanger intermediate to and connecting the first dispenser to the second dispenser wherein said first dispenser is separate from the said second dispenser, which hanger is adapted for removably hanging the device upon a portion of the rim of the cistern.

2. A device according to claim 1 wherein the first dispenser comprises a sidewall having at least one perforation passing through said sidewall.

3. A device according to claim 1 wherein the second dispenser comprises a cavity containing a fragrance composition.

4. A device according to claim 1 wherein the hanger is flexible.

5. A device according to claim 1 wherein the hanger includes a bridge section having two downwardly depending legs.

6. A device according to claim 1 wherein the hanger includes a bridge section having two downwardly depending legs having different lengths.

7. A device according to claim 1 wherein the treatment composition is in the form of a solid block.

8. A device according to claim 1 wherein the treatment composition is in the form of a gel.

9. A process for delivering a treatment composition to the interior of a cistern of a toilet bowl, which process comprises the process steps of:

providing a device according to claim 1, and installing the device upon the cistern such that the said treatment composition of the first dispenser is immersed within water contained within the cistern between flushes of the toilet bowl, while the second dispenser continuously provides a fragrancing effect to the ambient environment of the toilet bowl.

* * * * *